United States Patent [19]

Flanagan

[11] 4,047,877

[45] Sept. 13, 1977

[54] COMBUSTION METHOD AND APPARATUS

[75] Inventor: Paul Flanagan, Princeton, N.J.

[73] Assignee: Engelhard Minerals & Chemicals Corporation, Iselin, N.J.

[21] Appl. No.: 708,557

[22] Filed: July 26, 1976

[51] Int. Cl.[2] ..... F02C 3/16

[52] U.S. Cl. ..... 431/8; 60/39.02; 60/39.06; 60/39.69 A; 431/7; 431/353

[58] Field of Search ..... 431/2, 7, 10, 8, 170, 431/174, 285, 328, 353; 60/39.06, 39.02, 39.03, 39.04, 39.69 A

[56] References Cited

U.S. PATENT DOCUMENTS

| | | | |
|---|---|---|---|
| 3,376,098 | 4/1968 | Pryor | 431/10 |
| 3,914,091 | 10/1975 | Yamagishi et al. | 431/10 |
| 3,940,923 | 3/1976 | Pfeffrle | 60/39.06 |
| 3,982,879 | 9/1976 | Pfeffrle | 431/10 |

*Primary Examiner*—Edward G. Favors

[57] ABSTRACT

Combustion of the carbonaceous fuels such as fuel oil may be carried out advantageously in the presence of an oxidation catalyst body. Under suitable operating conditions the combustion can be effected at high rates of energy release for a catalyst and combustor of a given size, producing an effluent substantially free of pollutants. However, for a given combustor installation it may be desirable at times to utilize a thermal burner, associated with the catalyst arrangement, which is disposed for directing jets of burning gaseous fuel such as natural gas from a multiplicity of points just downstream of the catalyst. Thus combustion of the gaseous fuel in such jets is obtained substantially throughout a cross section of the downstream zone through which catalyst effluent passes. When a fuel-air mixture is being fed to the catalyst simultaneously with such supplying of gaseous fuel, the thermal burner preferably is arranged to effect coalescing of the jets of burning gaseous fuel and intermixing thereof with substantially all of the effluent from the catalyst. Such intermixing may serve to assist the combustion of any fuel which passes the catalyst without complete combustion during warm-up.

32 Claims, 13 Drawing Figures

Fig. 6.
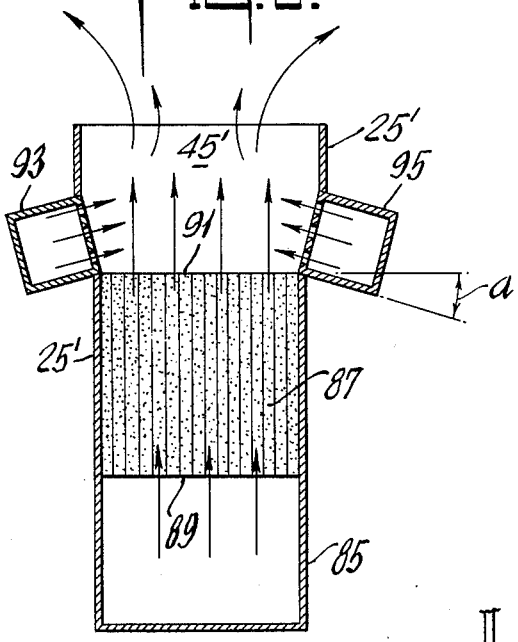
Fig. 7.
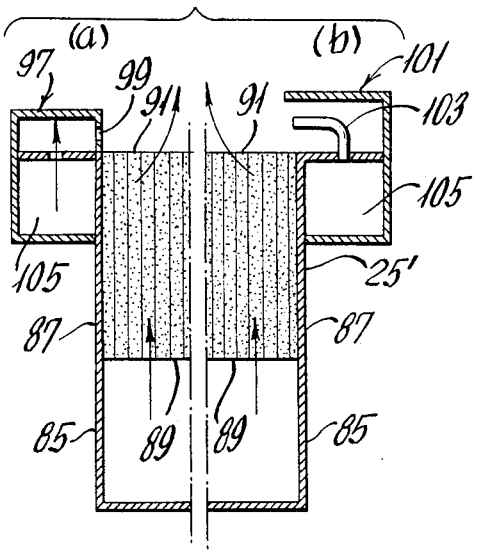
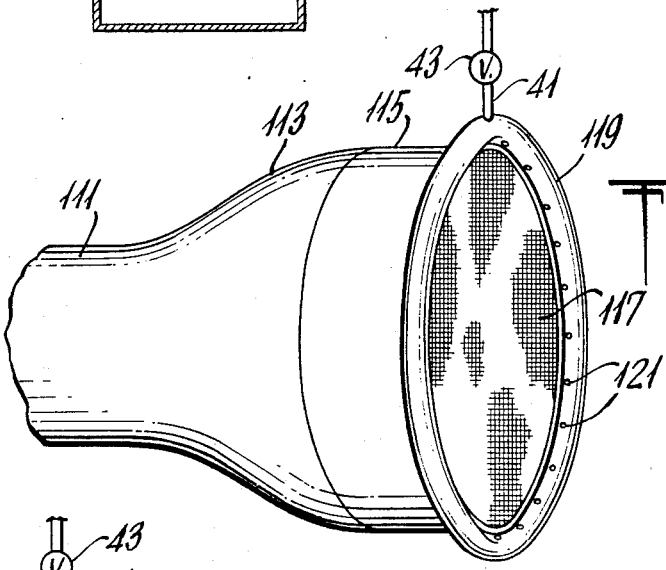
Fig. 8.
Fig. 9.
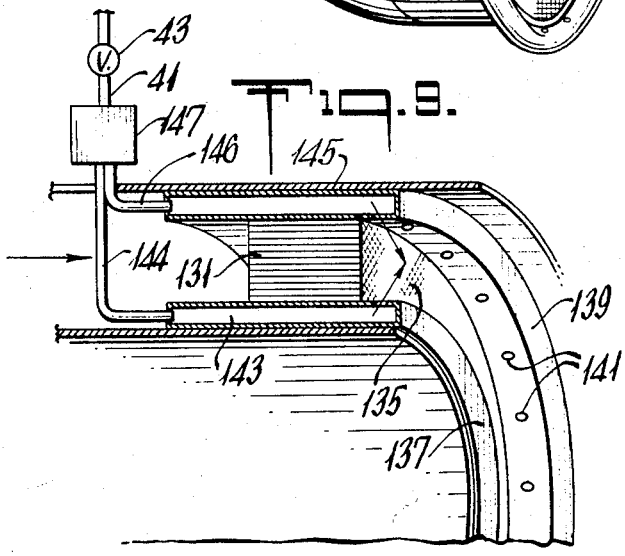
Fig. 12.
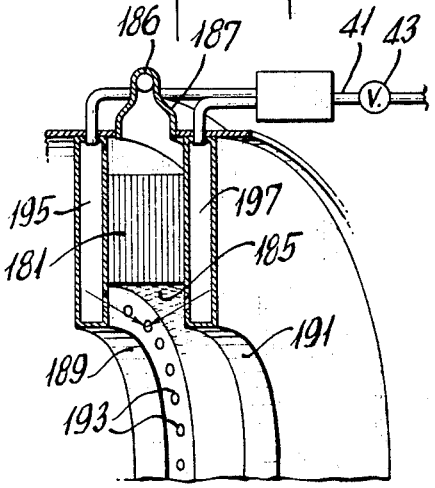

COMBUSTION METHOD AND APPARATUS

BACKGROUND OF THE INVENTION

This invention relates to methods and apparatus for combusting carbonaceous fuel, and more particularly for combusting such fuels in the presence of a catalyst to produce a hot gaseous effluent for use as a source of heat, as in a furnace or heat-treatment system, or as a source of power such as a motive fluid in a turbine system.

In U.S. Pat. No. 3,928,961, granted Dec. 30, 1975, in the name of William C. Pfefferle and assigned to the same assignee as that of the present invention, there is disclosed a process designated catalytically-supported, thermal combustion. According to this method carbonaceous fuels can be combusted very efficiently in the presence of a solid oxidation catalyst at thermal reaction rates but at temperatures below nitrogen oxide-forming temperatures. However, such combustion occurs efficiently only within a range of temperatures above an approximate minimum temperature, of the order of 1700°-2000° F, below which very substantial proportions of incompletely combusted fuel, usually in the form of hydrocarbons or carbn monoxide or both, may leave the catalyst to constitute a pollution nuisance. In fact, at the start-up of combustion the catalyst may be below the temperature at which it can readily ignite the mixture of carbonaceous fuel and combustion air fed to it, especially since this mixture may have a fuel-air ratio near or outside the limits of flammability under the conditions prevailing at the entrance to the catalyst. Until the temperature of the catalyst has been raised past the ignition temperature and preferably to a temperature approaching or at the final or steady-state operating temperature of the catalyst, it is highly desirable to provide means for assuring complete combustion of most or substantially all of the catalyst effluent which may be incompletely combusted. The proportion of incompletely combusted carbonaceous fuel found in the catalyst effluent during the warm-up period may be augmented, when using a liquid fuel such as No. 2 fuel oil, by failure to obtain an intimate admixture of the fuel and the combustion air prior to entry into the catalyst, caused by lack of sufficient preheating of the fuel-air feed during the warm-up period. In some combustion systems the preheating of the feed is obtained by heat transfer from the effluent of the combustion apparatus, or by compression of the combustion air as in a turbocharger driven by the combustion effluent. Since these preheating arrangements may be relatively ineffective during start-up of the combustion apparatus, an auxiliary source of heat may be required to effect start-up and attainment of a catalyst temperature within the operating range in a reasonably short length of time.

In U.S. patent application Ser. No. 645,017, filed Dec. 29, 1975, in the name of Asmund A. Boyum and assigned to the same assignee as that of the present invention, a method of combusting carbonaceous fuel is disclosed and claimed which involves combusting a first mixture of carbonaceous fuel and air in the presence of a catalyst to produce a catalyst effluent, providing another carbonaceous fuel-containing component differing from the first mixture, and mixing the catalyst effluent and such fuel-containing component to form a second mixture which is capable of homogeneous combustion to produce a hot effluent. Such a method may be useful in effecting efficient combustion of carbonaceous fuel of a type difficult to burn or undesirable for burning in the presence of a catalyst. In general, the combustion method of the aforementioned application is useful in continuous operation and requires the availability of a catalyst effluent from a catalyst combustion stage in which the catalyst has reached a temperature within its ordinary operating range. Such a method also may require preliminary start-up of the catalyst stage, and the method and apparatus of the present invention may be utilized for facilitating and improving operation during warm-up of the catalyst used in the method of the Boyum application.

SUMMARY OF THE INVENTION

Accordingly, a new and improved combustion apparatus comprises a catalyst body for combusting carbonaceous fuel passing therethrough, and feed means for supplying a mixture of combustion air and carbonaceous fuel to the catalyst body for flow therethrough to provide a catalyst effluent traversing a downstream zone adjacent to and downstream of the catalyst body. Thermal burner means are disposed for directing jets of burning gaseous fuel into the downstream zone from a multiplicity of points distributed within or alongside the downstream zone to obtain combustion of the gaseous fuel in such jets substantially throughout a cross section of the downstream zone. Burner supply means are provided for supplying gaseous fuel when desired to the burner means for obtaining such combustion in the jets. In a preferred combustion apparatus, the thermal burner means is disposed to obtain coalescing of the jets of burning gaseous fuel and intermixing thereof in the downstream zone with substantially all of the catalyst effluent, for assisting the combustion of incompletely combusted carbonaceous fuel which may be present therein when a fuel-air mixture also is being fed to the catalyst.

In a combustion method feature of the invention, wherein carbonaceous fuel and air are passed through a catalyst body to provide an effluent which traverses the downstream zone, the improvement comprises directing jets of burning gaseous fuel into the downstream zone from a multiplicity of points distributed within or alongside that zone to obtain combustion of the gaseous fuel in such jets substantially throughout a cross section of the downstream zone.

In accordance with a preferred method of the invention for catalytically-supported, thermal combustion wherein carbonaceous fuel and air in intimate admixture are combusted in an oxidation catalyst body, the operating temperature of which (during steady-state operation) is substantially above the instantaneous auto-ignition temperature of the fuel-air admixture but below a temperature that would result in any substantial formation of oxides of nitrogen, the improvement comprises passing a mixture of the fuel and air in contact with the catalyst to provide an effluent which traverses the downstream zone, and jets of burning gaseous fuel likewise are directed into the downstream zone to effect the aforesaid coalescing of the jets and intermixing thereof with the catalyst effluent.

BRIEF DESCRIPTION OF THE DRAWINGS

The present invention is described further in connection with the following drawings, in which:

FIG. 6 is a sectional elevation taken in the direction 6—6 indicated in FIG. 5 and showing schematically the disposition of the thermal burner means included in the combustion apparatus;

FIG. 7 is a sectional elevation of the apparatus shown more generally in FIGS. 5 and 6, illustrating schematically two different embodiments, one at the upper left and the other at the upper right, of the thermal burner means and of the manifold for supplying gaseous fuel to such burner;

FIG. 8 is a perspective view of a combustion apparatus in accordance with the invention utilizing a disk-shaped catalyst body and a ring-shaped thermal burner adjacent to the outlet face of the catalyst body;

FIG. 9 is a cut-away perspective view of an alternative catalyst body and thermal burner means adapted for axial flow of the combustion fluids in regions adjacent to the inside surface of a cylindrical combustor housing, for incorporation in a modified form of the combustion apparatus of the present invention;

FIG. 12 is a cut-away perspective view of another alternative catalyst body and thermal burner means assembly adapted for flow of combustion fluids radially inward through the catalyst.

DETAILED DESCRIPTION

Figure 1:
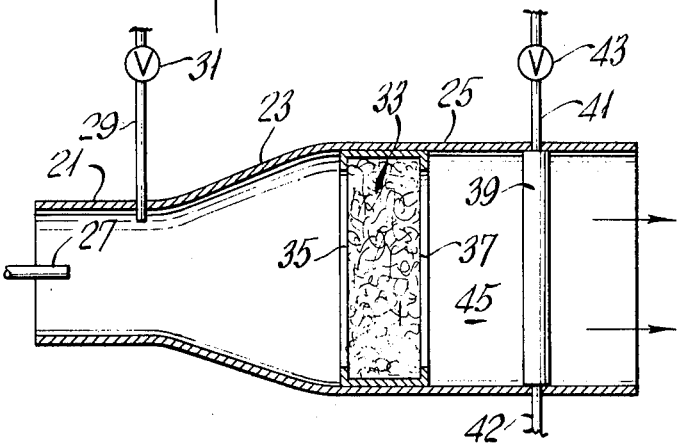
FIG. 1 is a schematic representation in longitudinal cross section of a combustion apparatus in accordance with the present invention which utilizes a solid oxidation or combustion catalyst, and which includes a thermal burner means downstream of the catalyst.

Referring first to the schematic representation of FIG. 1, the combustion apparatus includes a housing defining a mixing zone 21, a transition zone 23, and a combustion zone 25. Compressed air, which may be preheated during steady operation, is introduced to the mixing zone 21 through line 27, while a liquid carbonaceous fuel such as fuel oil or diesel oil is injected into the mixing zone through line 29 having a valve 31.

Disposed laterally across the upstream portion of the combustion zone 25 is a catalyst body 33 having an inlet face 35 and an outlet face 37. Downstream of the catalyst 33 there is disposed thermal burner means, indicated generally at 39, which is disposed across or at the sides of the combustion zone 25. The burner means is supplied with gaseous fuel through burner supply means of which the feed line 41 is shown. An additional feed line 42, if needed, may be included with a connection (not shown) to the line 41 for supplying gaseous fuel to the opposite side of the burner 39. The burner supply means includes control means, shown as a valve 43, for supplying the gaseous fuel at a desired rate. It will be understood that the valve 43 itself may be operated manually, if desired, or may in turn be controlled by programming means (not shown) for supplying the gaseous fuel to the thermal burner in accordance with a predetermined time schedule or in accordance with control signals derived from temperature and flow sensors (not shown) located upstream or downstream of the thermal burner.

The feed lines 27 and 29 and valve 31, along with the sources of compressed air and fuel oil and the mixing zone defined by the combustor housing section 21 (and its extension in transition zone 23), constitute feed means for supplying a mixture of combustion air and carbonaceous fuel to the inlet face 35 of the catalyst body 33 for flow through the body to provide a catalyst effluent traversing a downstream zone, indicated generally at 45, adjacent to and downstream of the outlet face 37 of the catalyst body. Combustion effluent, after passing through the downstream zone 45, leaves the downstream end of the combustion apparatus as indicated by arrows in the drawing. The feed means may include additional conventional fuel injection and fuel-air mixing means, not shown, for utilizing oil or other liquid carbonaceous fuel to supply a suitable admixture of air and carbonaceous fuel to the catalyst body.

In operation of the combustion apparatus shown schematically in FIG. 1, compressed air is supplied through line 27, and valve 31 is opened to permit flow of the fuel oil through line 29 into the mixing zone 21, using suitable spray nozzles or other devices associated with the line 29 entering the mixing zone for introducing the oil into the mixing zone 21 as a well distributed, finely divided spray or mist. Typically, at start-up, the valve 31 is adjusted relative to the flow of air through line 27 to provide a mixture which is flammable and may be ignited initially with the use of an igniter (not shown) within the region 21. Ignition may be facilitated by the fact that dispersion of the fuel oil by line 29 into the mixing region 21 in the form of droplets or a mist may not provide good vaporization or intimate admixture of the fuel and air initially, partly due to the low initial temperature of the mixing zone, permitting droplet combustion even if the air-fuel ratio is such as to provide a nonflammable mixture when intimately admixed. Care is taken during start-up to avoid flame impinging directly on catalyst 33, which might result in overheating of and damage to the catalyst. In any event the carbonaceous fuel tends strongly to be incompletely combusted during initial passage through the mixing zone and the cold catalyst, so that the catalyst effluent entering the downstream zone 45 may contain undesirably high proportions of pollutants during the start-up interval.

It will be understood that various expedients, not heretofore indicated with reference to FIG. 1, may be utilized as part of the aforementioned feed means for obtaining during steady operation of the combustion apparatus a desired admixture of fuel and combustion air at a desired temperature for passage at controlled rates into the inlet face 35 of the catalyst body 33. For example, the air introduced through the line 27 may be preheated by compression or otherwise. A variety of conventional arrangements (not shown in the drawings) is available for supplying air under controlled conditions of temperature, pressure, and rate of flow. Hot combustion products may be introduced in suitable admixture with air, or with air and fuel, into the mixing zone 21. All that is required is that the materials introduced into zone 21 and passed through the transition zone 23 reach the catalyst 33, after warm-up, in a desired condition of temperature and admixture, preferably in intimate, substantially homogeneous admixture, whether or not the lines 27 and 29 serve to feed air and fuel separately for mixing in the zone 21 as illustrated in FIG. 1. Nevertheless, until warm-up is completed the fuel and air may reach the catalyst at a lower temperature than desired, or with liquid fuel incompletely vaporized and poorly mixed with the air. Even if a hot, intimate admixture of fuel and air is presented to the catalyst during start-up, the catalyst may be too cold initially to effect efficient combustion.

Roughly simultaneously with ignition of the fuel-air mixture in the mixing region 21, and preferably shortly before admission of the fuel oil through valve 31 (or prior to admission of any fuel-air mixture by other means to the catalyst), the valve 43 may be opened to admit gaseous fuel to line 41 and the burner 39, and to provide burning gaseous fuel in the downstream zone 45 in a manner described in greater detail hereinbelow. An igniter (not shown) may be provided for initiating burning. Supplied in this manner, the burning gaseous fuel advantageously assists in the combustion of incompletely combusted carbonaceous fuel passing through the catalyst. This is brought about not only as a result of the higher temperature attained in the zone 45, providing ambient conditions conducive to complete oxidation, but also through the complete oxidation of fuel oil droplets which might be carried through the mixing zone and catalyst before operating temperatures are reached.

As the catalyst approaches a temperature within its operating range, the rate of supply of fuel oil may be adjusted by means of valve 31 to obtain the desired air-fuel ratio in the mixing region 21, and the stabilizing of operating temperatures and feed temperatures serves to ensure the desired dispersion of the fuel oil injected from line 29 and the provision of an intimate fuel-air admixture at the inlet to the catalyst. When these operating conditions have been reached, the gaseous fuel feed may be turned off or greatly diminished by manual or automatic operation of the valve 43. One arrangement for achieving automatic control of the burner supply means utilizes a temperature sensor (not shown) exposed to the catalyst 33, which may maintain a full fuel flow through valve 43 until the catalyst reaches a temperature over, say, 1500° F, and then may cause valve 43 to close completely when the catalyst reaches a temperature of, say, 2000° F.

In considering various embodiments described hereinbelow of the thermal burner means, it may be kept in mind that the gaseous fuel feed need not be at a high rate, since the time required for start-up and to achieve warm-up of the catalyst body utilizing the apparatus and method of the present invention is not critical, and typically is of the order of one minute or several minutes. Since production of pollutants during start-up is greatly ameliorated by the action of the burning gaseous fuel in the downstream zone 45, there is no great urgency in minimizing the length of the start-up period. The gaseous fuel, which thus may be supplied at relatively low pressures and low feed rates, is easy to mix with air and to ignite with controlled burning. Because the gaseous fuel is not introduced upstream of the catalyst, it is not necessary to supply the gaseous fuel at a high pressure which might be needed to overcome the pressure drop experienced by the compressed air and other combustion fluids passing through the catalyst body. The gaseous fuel may be fully or partially premixed with combustion air as supplied through line 41, or combustion air may be permitted to diffuse through suitable ports in downstream zone 45 with reliance on diffusion of oxygen to the burner, thus providing a diffusion flame in a manner well known in operation of burners designed for natural gas and the like. Alternatively, some or all of the necessary air for burning the gaseous fuel may be provided by the compressed air entering at line 27 and passing through the catalyst body 33. It will be understood that the burner supply means, represented by valve 43 and line 41, may be arranged in conventional fashion, in association with the thermal burner, to assure provision of both the gaseous fuel and oxygen needed for burning the fuel passing through the discharge openings in the burner.

A gaseous fuel is desirable which is readily available in the quantities needed for start-up of the combustion in the presence of the catalyst, and which can form the desired hot jets of burning fuel utilizing burners of uncomplicated design. Fuel gas burners of generally conventional design, such as those known as ring burners, line burners, ribbon burners, and the like, preferably are used, and such gaseous fuel burners may be adapted readily by those skilled in the art for inclusion in the combustion apparatus described herein, along with, as suggested hereinabove, any necessary arrangements for providing combustion air in suitable admixture with the gaseous fuel. Natural gas is well suited, when available from mains, for use as the gaseous fuel, or the gaseous fuel may be obtained locally in known manner and at suitable pressures from liquefied lower hydrocarbons or lower hydrocarbon mixtures. Liquid fuels are not suitable for feeding directly into such burners, whether atomized or not. However, in the absence of other gaseous fuels, fuels which ordinarily are liquid may be vaporized or gasified in the necessary quantities by any conventional method, utilizing auxiliary equipment if necessary, for supplying the gaseous fuel to the thermal burner means 39.

Referring again to the portion of the combustion apparatus which includes the mixing zone 21 with its supply of fuel oil and air, the transition zone 23, and the catalyst body 33 in the upstream portion of combustion zone 25, this portion of the apparatus preferably is utilized to carry out catalytically-supported, thermal combustion in the catalyst 33, as described and defined in the aforementioned Pfefferle U.S. Pat. No. 3,928,961. In carrying out such combustion, upon attainment of sustained operating conditions as may be facilitated by use of the thermal burner 39, the fuel oil and air, having attained intimate admixture, are combusted in the catalyst 33 the operating temperature of which is substantially above the instantaneous auto-ignition temperature of the fuel-air admixture but below a temperature, of the order of 3300° F, that would result in any substantial formation of oxides of nitrogen. The instantaneous auto-ignition temperature for the fuel-air admixture is defined as that temperature at which the ignition lag of the fuel-air mixture entering the catalyst is negligible relative to the residence time in the catalyst combustion zone of the mixture undergoing combustion therein.

Thus the passing of the mixture of fuel and air from the zones 21 and 23 in contact with the catalyst body is continued over a period of time which includes an interval, prior to attainment of sustained operating conditions, during which the catalyst body is at a temperature below the operating temperature such that the effluent from the catalyst traversing the downstream zone 45 contains substantial proportions of incompletely combusted carbonaceous fuel. Operation during such interval, preferably assisted by the thermal burner 39, results in attainment of sustained operating conditions at which the catalyst temperature reaches its steady operating temperature approaching the adiabatic flame temperature of the fuel-air admixture at the inlet to the catalyst. In the combustion system indicated schematically in FIG. 1 no heat is removed from the combustion zone 25 except for incidental heat loss by conduction through the walls of the zone 25 and by some incidental radiation from the faces of the catalyst. Under such essentially adiabatic combustion conditions the operating temperature of the catalyst approaches, within a temperature of the order of 150° F, the adiabatic flame temperature of the inlet fuel-air admixture, and typically the catalyst operating temperature is about 50°-100° F lower than that adiabatic flame temperature, so that continued combustion in the presence of the catalyst proceeds efficiently. However, at least during the catalyst warm-up interval, the thermal burner 39 preferably is operated to direct the jets of burning gaseous fuel into the downstream zone 45.

Figure 2:
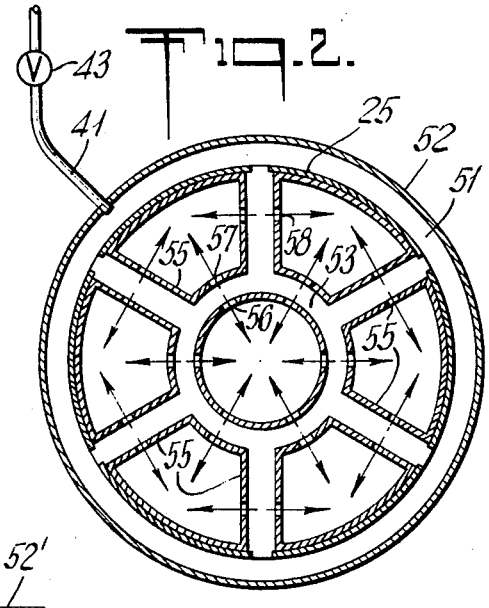
FIG. 2 is a cross-sectional view of one form of the thermal burner means shown schematically in FIG. 1, this view being a section taken perpendicularly to the axial direction of the combustion fluid flow in the combustion apparatus.

FIG. 2 illustrates in cross section, viewed in the axial direction, an arrangement of the thermal burner means 39 in which burner elements are disposed in the flow path of the catalyst effluent traversing the downstream zone 45. This arrangement utilizes a torroidal fuel supply manifold 51 provided between the housing section 25 and a short external cylindrical cover 52, which is outside of the combustion housing section 25 and thus protected from the high temperatures attained by the combustion products. The gaseous fuel supply line 41 having control valve 43 passes through the cover for supplying the manifold 51. It may be seen that the thermal burner of FIG. 2 is suited for use when the catalyst outlet face 37 and the downstream zone 45 are generally circular in cross section. As will be appreciated, however, it is not necessary that the catalyst or the combustion housing 25 be of circular shape, since oval cross sections or cross sections enclosed by a polygonal shape may in certain circumstances be more convenient. Thus a catalyst body may be made up of an assembly of shapes, such as triangular shapes as seen in cross section perpendicular to the axis, arranged in lateral abutment so that the periphery is made up of chords formed by one side of each triangle, which together provide an equilateral polygon establishing a generally circular shape around the periphery of the assembly. Such a catalyst body thus may be fitted readily around the periphery of its exit face with thermal burner means of generally circular or ring shape.

Referring again to FIG. 2, the torroidal manifold 51 enables an annular burner section 53 to be disposed across the downstream zone 45 so as to permit flow of a substantial part of the gases traversing the zone 45 centrally through the burner section 53. The burner section 53 is supported and fed by radial tubes 55 depending from the housing section 25 and providing gas flow passages from the manifold 51 to the burner section 53, thus leaving spaces between each adjacent pair of tubes so as to permit flow of a substantial part of the gases traversing the zone 45 through each of those spaces. The design of the burner section 53 and tubes 55 is such that together they occupy a minor total portion of the cross-sectional area of the downstream zone and thus present a minimal obstruction to the longitudinal flow of the gases, so that the thermal burner means made up of the manifold 51, the burner ring 53, and the radial tubes 55 can be disposed as described without substantially impeding the flow of the catalyst effluent, at least during periods when the burner supply means 41, 43 is not supplying gaseous fuel to the thermal burner means.

The burner means 39, and specifically the burner ring 53 and radial tubes 55 of the arrangement in FIG. 2, preferably are disposed and arranged for directing jets of burning gaseous fuel generally transversely of the flow of catalyst effluent from the catalyst outlet face 37 into the zone 45. These jets are directed from a multiplicity of points distributed alongside — or within, as shown in FIG. 2 — the zone 45. These points from which the jets are directed are provided in the arrangement of FIG. 2, as indicated by arrows in the drawing, by a multiplicity of discharge openings 56 around the annular burner section 53 facing generally radially inwardly. A multiplicity of additional discharge openings 57 is provided around the annular burner section 53 facing generally radially outwardly and also additional openings 58 along each of the radial tubes 55 facing generally circumferentially.

It will be recognized that, with generally symmetrical burner arrangements such as those described and illustrated herein, the burner structure should be designed in ways known to the art to pass the gaseous fuel through each discharge opening at about the same rate. This involves, of course, not only the size and configuration of the openings themselves, but also the sizes and orientation of the internal passageways through which the gas moves to reach the openings, along with the provision of adequate fuel supply manifolding arrangements including such internal passageways and of adequate supply lines including line 41 and possibly additional lines such as line 42 (FIG. 1) for feeding the fuel manifold at one or more points. The burner shown in FIG. 2 is fed to provide a multiplicity of jets aimed from the discharge openings in a variety of directions, some jets opposing and merging with other jets, which are effective (when the gaseous fuel is supplied under adequate pressure at a sufficient rate) to obtain combustion of the gaseous fuel in the jets substantially throughout a cross section of the downstream zone 45, excluding of course the portions occupied by the burner section 53 and radial tubes 55. This arrangement, in fact, effects coalescing of the jets of burning gaseous fuel and intermixing thereof in the zone 45 with substantially all catalyst effluent present, thus assisting the combustion of any incompletely combusted carbonaceous fuel in that effluent. In general, the size, shape, orientation, and placement of the multiplicity of discharge openings should be designed, using arrangements known for gas and jet burners, so as to obtain the desired configuration of jets of burning gaseous fuel with the gas pressure available for a given installation, resulting when desired in combustion of the gaseous fuel throughout the downstream zone 45, coalescing of the jets, and intermixing thereof with catalyst effluent present.

Figure 3:
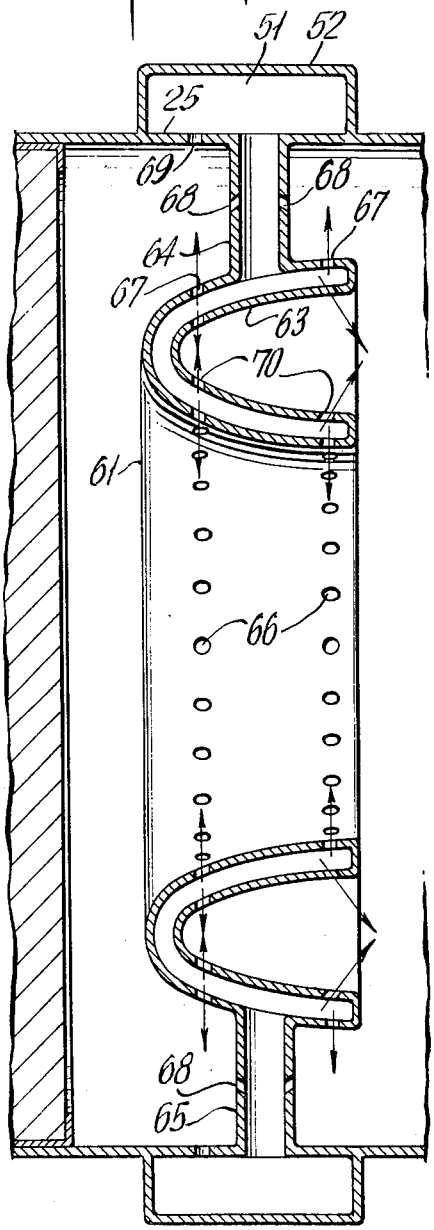
FIG. 3 is an enlarged partial longitudinal sectional view, taken through the axis of the apparatus, showing an alternative form of the thermal burner means.

FIG. 3 illustrates an alternative arrangement of thermal burner means disposed in the path of the catalyst effluent in the downstream zone 45. As viewed in FIG. 3, the thermal burner is seen in a cross-sectional view sectionalized through a plane including the central axis of the combustion apparatus. The main body of the burner is a hollow figure of revolution about the central axis and is generally U-shaped where intersected by the plane of the cross-sectional view near the top and again near the bottom of FIG. 3. In any axial cross section the hollow body presents a convex face 61 to the upstream portion of the apparatus and a concave face 63 to the downstream portion of the apparatus, the convex shell 61 and the concave shell 63 being joined at their respective inner and outer downstream ends to complete the enclosure. This body is supported by two hollow struts 64 and 65 fastened internally to opposite sides of the combustor housing section 25. As in FIG. 2, a gaseous fuel supply manifold 51 is formed by a hollow cylindrical cover 52. Gaseous fuel is supplied through the struts 64 and 65 to the hollow ring-like body formed by the shells 61 and 63. A multiplicity of discharge openings 66 and 67 is provided around the inner and outer skirts respectively of the convex shell 61 for directing jets of burning gaseous fuel in directions respectively toward the central axis of the zone 45 and toward the cylindrical wall of the combustor section 25, and for intermixing with the catalyst effluent flowing through the axial region surrounded by the inner skirt of shell 61 and between the outer skirt of shell 61 and the wall 25. Additional jets of burning gaseous fuel may be directed from openings 68 in the struts 65 and 67, and if needed additional openings 69 are directed radially inwardly from the supply manifold 51 to which the struts are attached, as well as openings 70 directed inwardly and downstream from the concave downstream shell 63.

In operation, gaseous fuel enters the struts 64 and 65 from the manifold 51 and passes between the shells 61 and 63 to reach the discharge openings 66–70. As with the arrangement of FIG. 2, the gaseous fuel is controlled through valve 43 and feed line 41 supplying the manifold 51 to obtain coalescence of the jets of burning gaseous fuel and intermixing therewith of the catalyst effluent.

Figure 4:
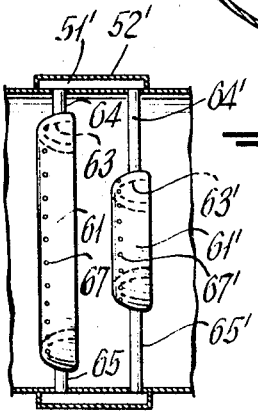
FIG. 4 is a simplified cross-sectional view of a thermal burner means including a first burner such as that shown in FIG. 3, disposed just downstream of the catalyst, and another similar but smaller burner disposed just downstream of the first burner.

FIG. 4 illustrates a modification of the arrangement of FIG. 3 in which the same struts 64 and 65 supply the hollow body having an upstream convex face 61 and a downstream convex face 63 and also having gas discharge openings as shown in detail in FIG. 3. The body 61, 63 is supplied by a wider manifold 51' formed by cylindrical cover 52'. A second hollow body, likewise of U-shaped cross section, also is provided across the inner portion of the downstream zone 45, and downstream of the body 61, 63. This second hollow body, of smaller radial extension from the axis of the combustor, has a convex upstream face 61' and a concave downstream face 63', like numerals being used for elements similar to those shown in FIG. 3. The hollow body 61', 63' is supported by and fed from struts 64' and 65' connected to opposite sides of the manifold 51', and has jet openings 66' in face 61', and likewise in face 63', similar to the respective openings 66 and 70 in the body 61, 63.

In operation, the FIG. 4 arrangement functions as does that of FIG. 3, except that for combustors of relatively large diameter the intermixing of the jets of burning gaseous fuel with the combustor effluent is more readily effected by the jets of burning gas from both the larger body 61, 63 and the smaller body 61', 63'.

When the thermal burner means includes members disposed in the path of the catalyst effluent, as in FIGS. 2–4, such members are exposed to combustion products at high temperatures during start-up and of course during normal operation of the combustion apparatus. To minimize deterioration of the burner members it is helpful to maintain a flow of cool gases through the feed lines and hollow members of the burner at all times during start-up and continued operation. Thus during start-up a mixture of the gaseous fuel and cool combustion air will serve as coolant for the exposed structural members.

The catalyst body 33 generally may take any of numerous shapes and forms, and may utilize various active catalytic materials which may be deposited on substrates having lesser activity or on catalytically inactive substrates for effecting the desired combustion of the mixture formed in section 21 of FIG. 1. Thus the catalyst body may be made up of a mass of extrudates or other pellets or a mass of particulate material, each pellet or particle of which carries a coating of catalytically active material. Such pelletized or particulate catalysts are retained within a housing or canister which has openings at one end forming the inlet face of the entire catalyst body and openings at the other end forming the outlet face of the catalyst body. The spaces between the pellets or particles provide flowthrough passageways for the combustion fluids. The catalyst body may take the form of a screen or stack of screens fabricated from wire of catalytically active material, the inlet face being one side of the screen or stack and the outlet face the other side.

In a preferred form the catalyst body is a monolithic or unitary body of sintered refractory oxidic material, formed with thin-walled honeycomb-type structures extending generally from an inlet face to an outlet face and providing flowthrough passageways therebetween for the combustion fluids. The surfaces of these interior flowthrough passageways typically may be provided with a porous film or coating, typically of alumina which may include another oxide such as ceria or mixture of oxides to improve high temperature stability. This coating may be impregnated with catalytically active materials which are also heat-resistant, such as one or more of the platinum group metals. The catalyst body 33 shown generally in FIG. 1 thus may be such a monolith of disk or cylindrical shape, the effluent from which traverses a downstream zone 45 of generally circular cross section.

Figure 5:
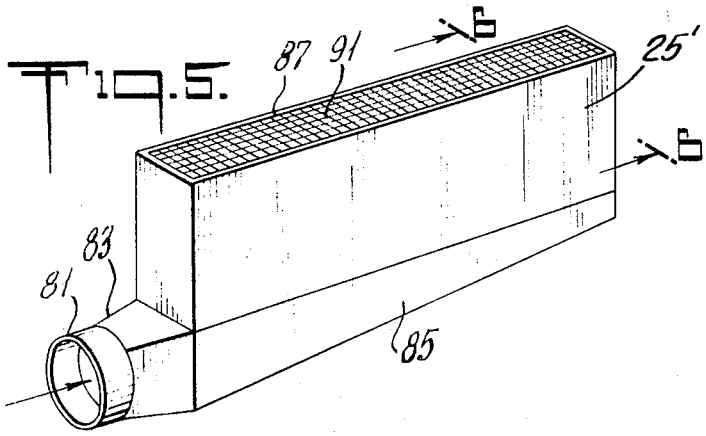
FIG. 5 is a perspective view of a combustion apparatus in accordance with the invention utilizing an elongated, longitudinally extensive catalyst body, the thermal burner means being omitted from the view of FIG. 5 for ease of illustration.

In a preferred embodiment of the present invention, a monolith catalyst body of modified shape is used which is elongated or longitudinally extensive in a direction transverse to the orientation of its flowthrough passageways, so that it has elongated or longitudinally extensive inlet and outlet faces and an elongated or longitudinally extensive downstream zone adjacent to the outlet face. Such a catalyst body is shown in FIGS. 5 and 6. A carbonaceous fuel-air mixture, which is supplied heated as indicated hereinabove after the combustion apparatus reaches operating temperature, enters the apparatus through a duct 81 and passes through a transition duct 83 to feed one end of a longitudinally extensive duct 85 which is tapered, in its thickness or vertical direction, from left to right as illustrated to equalize the pressure along the duct. The longitudinally extensive catalyst body 87 has an inlet face 89 (hidden in FIG. 5) and an outlet face 91. The catalyst effluent leaves the outlet face 91 simultaneously along the entire length of the catalyst body 87 and thus enters the downstream zone 45' defined by part of a combustor wall section 25' (not shown in FIG. 5 for ease of viewing) extending downstream of the catalyst (upwardly in FIG. 6) along the entire length of the elongated downstream zone. It is seen that the carbonaceous fuel-air mixture changes its direction from horizontal to vertical as it enters the catalyst body from the tapered supply duct 85. The arrangement including also the thermal burner means appears in vertical section in FIG. 6. A suitable catalyst body may be, for example, 3 inches (7.5 cm) in the direction of the flowthrough passageways between the inlet and the outlet faces 89 and 91, 16 inches (40 cm) in its elongated or longitudinally extensive dimension, and 1.5 inches (3.8 cm) in its other cross-sectional dimension; the inlet to the tapered supply duct 85 as seen in FIG. 5 thus may be of rectangular shape and approximately 1.5 inches (3.8 cm) wide and 3.75 inches (9.5 cm) deep.

Referring particularly to FIG. 6, a section through the terminal portion of the supply duct 85 and the catalyst body 87 is shown with a line burner 93 disposed along and adjacent to one longitudinally extensive edge of the outlet face 91 and a similar burner 95 disposed along the other longitudinally extensive edge of the outlet face, so that, with reference to the outlet face 91, the line burners 93 and 95 are correspondingly longitudinally extensive, or elongated in a direction transverse to the fluid flow. As seen in FIG. 6 the downstream zone 45' is above and adjacent to the outlet face 91. The line burners 93 and 95 are disposed for directing jets of burning gaseous fuel into the downstream zone from each of the generally opposed, longitudinally extensive sides thereof at a predetermined penetration angle *a,* determined by the angle of the plane of the outlet face 91 and the direction of the jets leaving the burner means. The penetration angle may be adjusted when the apparatus is set up. The line 41 and valve 43 (not shown in FIGS. 5 and 6) supply gaseous fuel to the burners 93 and 95 at a rate sufficient, for the predetermined penetration angle *a,* to effect the coalescing of the jets of gaseous fuel and the intermixing of the burning gaseous fuel with substantially all of the catalyst effluent leaving the outlet face 91. It will be seen from the arrows in FIG. 6 that the coalescing of the generally opposed jets from the burners 93 and 95 occurs in the inner regions of the downstream zone, midway between the line burners, and forms a gas burner combustion flume (illustrated by arrows at the top of FIG. 6) which envelops and engulfs the catalyst effluent and achieves the desired intermixing of burning gaseous fuel and the catalyst effluent.

FIG. 7 is a sectionalized view similar to that of FIG. 6 with alternative forms of the line burners 93 and 95 shown in greater detail. In this case a penetration angle of 0° is used; that is, the jets of burning gaseous fuel are introduced directly across the downstream zone along the outlet face 91 of the catalyst body. A supply manifold 105 for the gaseous fuel is shown alongside each longitudinally extensive side of the combustor housing holding the catalyst 87, it being understood that both manifolds are fed at their ends or at intermediate points from the supply line 41 with control valve 43.

The burner 97 illustrated in cross section at the upper left of FIG. 7 is of a type known as a ribbon burner. A ribbon-like structure 99 of corrugated shape provides a multiplicity of successive openings along the length of the burner, each opening being the source of a jet of burning gaseous fuel extending across the outlet face 91 of the catalyst. The burner 101 illustrated at the upper right of FIG. 7 is a succession of closely spaced fuel supply nozzles 103 individually supplying a jet of burning gaseous fuel. The gaseous fuel is supplied to the burners, whether of the type of burner 97 or of burner 101, through the manifolds 105 supported on each side of the catalyst housing 25' near the outlet face 91 of the catalyst. It will be understood that a conventional line burner in the form of a tube having spaced therealong circular openings for emitting the gaseous fuel into the downstream zone 45' may be used in place of the ribbon burner 99 or the succession of burner nozzles 103.

FIG. 8 illustrates an alternative form of thermal burner means for use with a catalyst body of circular cross-sectional shape, preferably having the form of a cylindrical monolith with flowthrough passageways extending axially therethrough, or extending in the thickness direction if the monolith is viewed as a disk. The fuel-air mixture for the catalyst enters the apparatus through a supply duct 111 and a transition duct 113 into a cylindrical housing 115 of larger diameter, within which is secured the disk-shaped honeycomb catalyst having an outlet face 117. With disk-shaped honeycombs of small diameter the transition duct may be unnecessary, and the supply duct 111 then conveniently may be connected directly to the housing 115.

Downstream of the outlet face 117 a ring burner 119 is positioned, having distributed therearound a multiplicity of burner jet openings 121 directed generally inwardly across the catalyst outlet face 117. The ring burner 119 may have an inner diameter closely the same as the effective outer diameter, excluding mounting members, of the catalyst outlet face 117. The ring burner 119, as in FIG. 1 and the other illustrated embodiments, is supplied with gaseous fuel through a line 41 having a valve 43.

The FIG. 8 arrangement may be compared for example with the arrangement illustrated in FIG. 2. While the structure of the exterior ring burner of FIG. 8 is not directly exposed to the hot effluent from the catalyst face 117 and moreover cannot block the flow of the catalyst effluent, it will be understood that the ability of the jets of burning gaseous fuel to obtain combustion substantially across the downstream zone is limited for a given fuel pressure to a combustion zone of smaller diameter, and that coalescing of the jets emitted from opposed openings 121 cannot be expected to occur with intermixing with the catalyst effluent across the downstream zone 45 of a diameter as great as that of the downstream zone which may be covered by the jets from the various members of the FIG. 2 arrangement including the annular burner section 53 disposed in a position intermediate the central axis and the circumference of the downstream zone 45.

FIG. 9 illustrates in cutaway view a portion of a ring-shaped combustion catalyst having flowthrough paths in the axial direction through the catalyst body all around the ring. The catalyst body 131 is mounted to receive the fuel-air mixture in the axial direction for passage from the inlet face 133 (not exposed in FIG. 9) to the outlet face 135 of the catalyst body. The downstream zone adjacent to the outlet face 135 is provided adjacent to its circular inside and outside edges individually with an inner ring burner 137 and an outer ring burner 139, each having a multiplicity of discharge openings directed across the outlet face of the catalyst in a direction generally radially of the catalyst assembly. The inwardly directed discharge openings 141 of the outer ring burner 139 are visible in FIG. 9, and a similar multiplicity of discharge openings for the gaseous fuel is provided, directed generally radially outwardly, on the inner ring burner 137. The inner burner 137 is fed through an inner manifold 143 and supply line 144, while the outer burner 139 similarly is fed through an outer manifold 145 and supply line 146. A fuel manifold 147 feeds the two supply lines 144 and 146, and is supplied in turn, as with the other illustrated embodiments, from a line 41 having a control valve 43.

Figure 10:
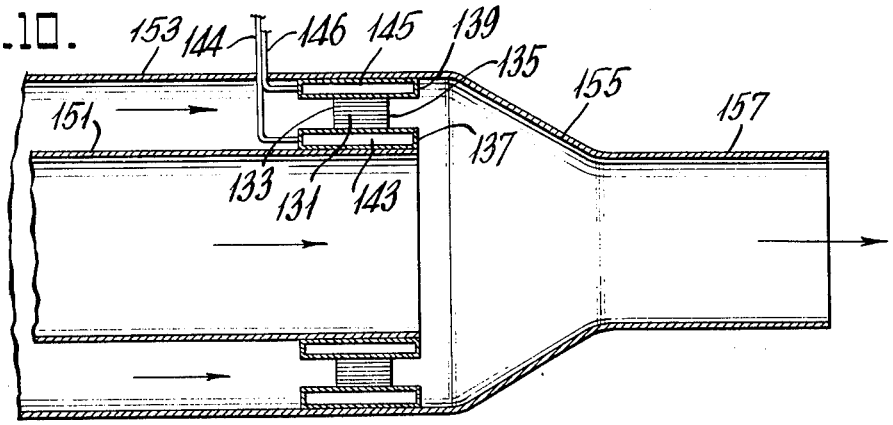
FIG. 10 is a partially schematic representation in axial cross section of a combustion apparatus incorporating the catalyst body and thermal burner depicted in FIG. 9 and arranged for treatment of gases passing centrally through the apparatus in the axial direction.

An arrangement utilizing the ring-shaped catalyst body 131 of FIG. 9, with ring burners 137 and 139 around and adjacent to the inner and outer edges respectively of the outlet face 135, is shown partly schematically in FIG. 10. A duct 151 for air from a blower (not shown) to be tempered or heated and then distributed enters the combustion apparatus from one side and passes axially through the central region of the burner assembly. A mixture of carbonaceous fuel and air enters between the duct 151 and an outer cylindrical housing 153 for passage axially through the ring-shaped catalyst body 131 around its entire periphery. The manifolds 143 and 145 for the ring burners are fed by corresponding lines, shown schematically as lines 144 and 146, both of which are fed with gaseous fuel from a valved supply line as in FIG. 9.

In operation the fuel-air mixture or combustion products leaving the catalyst through its outlet face 135 may be cleaned of incompletely combusted carbonaceous fuel, during warm-up of the catalyst, through the action of the multiplicity of jets of burning gaseous fuel originating at the discharge openings in the ring burners 137 and 139 and directed in opposing radial directions across the zone immediately downstream of the outlet face 135. The supply of gaseous fuel to the thermal burners 137 and 139 may be continued if desired to supplement the combustion in the presence of the catalyst after warm-up, or under suitable circumstances the thermal burners may be operated when no fuel is being supplied to the catalyst. In all cases, the resulting hot combustor effluent then mixes, within a region 155 of the housing of decreasing diameter, with the air from the duct 151, and the resulting tempered air is distributed by way of an outlet duct 157.

Figure 11:
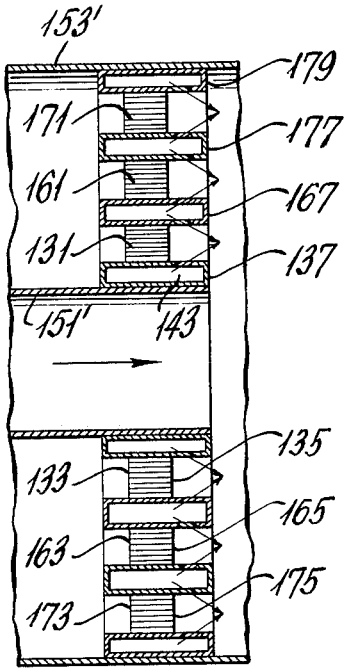
FIG. 11 is a cross-sectional representation, similar to FIG. 10 but illustrating a nesting arrangement of three catalyst and burner assemblies, each similar to that shown in FIG. 10, but of progressively smaller diameters.

When larger combustion capacity and cross-sectional area are needed for producing the hot gases than are available in FIG. 10 between the air duct 151 and the outer housing 153, the arrangement illustrated in FIG. 11 may be utilized. As seen in FIG. 11 the air duct 151' is surrounded by an outer housing 153' of relatively much greater diameter. The catalyst body 131 as shown in FIG. 10 may be used in a position closely surrounding the air duct 151'. Some of the fuel-air mixture supplied through the space between 151' and 153' then passes through the body 131 from its inlet face 133 to its outlet face 135. The inner ring burner 137, supplied by its manifold 143, directs jets of burning gaseous fuel outwardly across face 135 as illustrated in FIG. 10.

A second ring-shaped catalyst 161 likewise having ring-shaped inlet and outlet faces 163 and 165 surrounds the catalyst body 131. In like manner portions of the fuel-air mixture pass between the inlet face 163 and outlet face 165 of the catalyst 161 to enter a downstream zone adjacent to the face 165. In place of the outer ring burner 139 shown in FIG. 10, a ring burner 167 is interposed between the downstream zones adjacent to the respective catalysts 131 and 161. The burner 167 has two sets of jet openings (not shown), one directed radially inwardly across the outer portions of the zone downstream of catalyst face 135, and the other directed radially outwardly across the inner portions of the downstream zone adjacent to the face 165. Thus the inwardly directed jet openings in the burner 167 perform the functions of the burner 139 in the FIG. 10 arrangement.

A third ring-shaped catalyst 171 having ring-shaped inlet and outlet faces 173 and 175 surrounds the catalyst body 161. In like manner the remaining portions of the fuel-air mixture pass between the inlet face 173 and outlet face 175 of the catalyst 171 to enter a downstream zone adjacent to the face 175. Another ring burner 177 is interposed between the downstream zones adjacent to the respective catalysts 161 and 171. The burner 177 has two sets of jet openings (not shown), one directed radially inwardly across the outer portions of the zone downstream of catalyst face 165 and the other directed radially outwardly across the inner portions of the downstream zone adjacent to the face 175. Finally, an outer ring burner 179 is provided, analogous to the outer burner 139 of FIG. 10, for forming a plurality of jets of burning gaseous fuel directed radially inwardly across the outer portions of the downstream zone adjacent to the catalyst face 175. Each of the ring burners 137, 167, 177, and 179 is provided with an individual annular manifold, analogous to the manifolds 143 and 145 in the FIG. 10 arrangement, and each of the last-mentioned manifolds is supplied through suitable lines and a common manifold (not shown) from the supply line 41 having the control valve 43. It will be understood that in operation the individual downstream zones traversed by the effluents from the respective radially nesting ring-shaped catalysts 131, 161, and 171 also are supplied throughout their respective cross sections by the respective pairs of inwardly and outwardly directed jets of burning gaseous fuel passing across each downstream zone, so that the combustion products from the three catalysts or from the three pairs of thermal burners, or from all of them, mingle downstream thereof, where they serve together to mix with and heat the air passing through the inner duct 151' for distribution.

Still another arrangement of a catalyst body and thermal burners is illustrated in FIG. 12. In this arrangement the effluent from the combustion apparatus is directed for convenient heat treatment of a product which may be passed axially through the apparatus. Referring to FIG. 12, a particulate or monolith catalyst body 181 is formed in a ring shape but with its flowthrough passageways extending from an outer cylindrical inlet face 183 (not exposed in FIG. 12) to an inner cylindrical outlet face 185. The body 181 may be formed of a succession of arcuate or straight lengths of monolith placed end to end at equal distances from a central axis and joined to form the ring-shaped body. The mixture of carbonaceous fuel and air for combustion is fed through a supply duct 186 into a circumferential manifold 187 and thence to the outer face for passage through the catalyst 181 to its inner outlet face 185. As the gases leave the outlet face, they may be subjected to a multiplicity of jets of burning gaseous fuel issuing from suitable discharge outlets in a first ring burner 189 on one side of the catalyst and a second ring burner 191 on the other side of the catalyst. Discharge openings 193 may be seen in FIG. 12 in the burner 189, these openings being oriented to direct the jets generally axially across the outlet face 185. A similar multiplicity of jets is directed in the opposing axial direction from discharge openings, not visible in Fig. 12, in the burner 191. The ring burners 189 and 191 are provided with radial supply ducts 195 and 197, shown in section at the top of FIG. 12, the ducts 195 and 197 being fed from the gaseous fuel supply line 41 through a suitable manifold or connecting lines.

Figure 13:
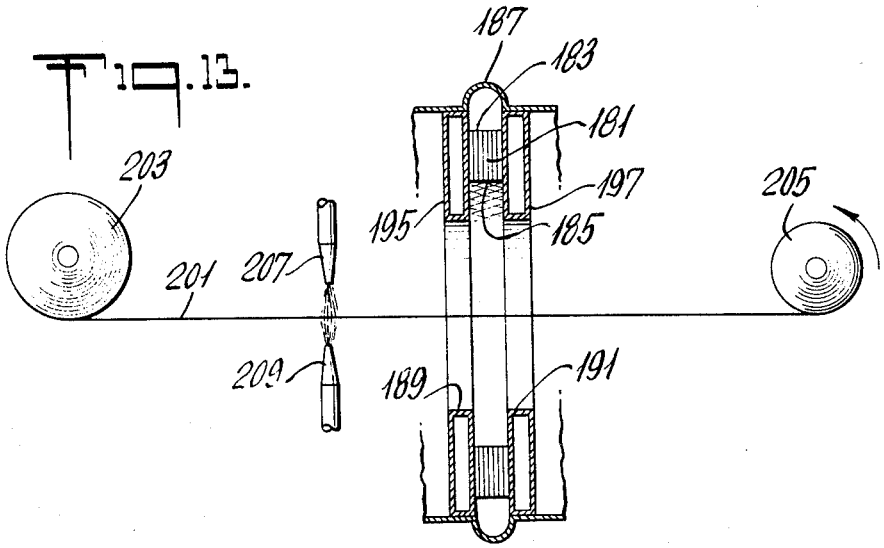
FIG. 13 is a partially schematic representation of the combustion apparatus of FIG. 12, illustrating the passage axially through the combustion apparatus of a work piece or pieces to be heated or heat-treated by the combustion effluent.

FIG. 13 illustrates the utilization of the combustion apparatus of FIG. 12 for heat-treating a workpiece or product which is passed axially through the center of the apparatus. Such a product might be a filament or ribbon 201 which is unwound from a supply spool 203 and stored after treatment on a take-up spool 205. The workpiece 201 may be coated, if desired, as it leaves the spool 203 by spray from opposed spray heads 207 and 209, whereupon the product is passed through the combustion apparatus for drying or other heat treatment by the combustion effluent issuing radially inwardly from the outlet face 185 of the catalyst body and reaching both sides of the workpiece to be treated, which thereupon passes to the take-up spool 205.

It will be appreciated that control of the thermal burner jets, to obtain combustion in the jets substantially throughout a cross section of the zone downstream of the catalyst, and when desired to effect coalescing of the jets and intermixing thereof with the catalyst effluent, will depend on the structural arrangement of the catalyst and thermal burner means including the nature and disposition of the jet supply openings in the thermal burner, on the velocity and flow characteristics of the catalyst effluent, and on the supply pressure of the gaseous fuel. With natural gas supplied at pressures typical of industrial combustion systems operating at ambient pressure, using a gas-air mixture pressure of, say, about 2–25 inches of water, a single jet of burning gas may be effective through a distance of the order of 1 inch or 3 cm across the outlet face of the catalyst. Thus with such a natural gas supply a rectangular catalyst outlet face with opposed, inwardly directed line burners along each side, as shown in FIG. 5, should not be more than about 2 inches wide, and a cylindrical or disk-shaped catalyst with its outlet face surrounded by a ring burner, as shown in FIG. 8, should not be much more than 2 inches in diameter. Similarly, in general, the ring-shaped outlet faces 135 in FIG. 9 and 185 in FIG. 12 should not extend more than about 2 inches in the radial direction of FIG. 9 or in the axial direction of FIG. 12, unless stronger jets of burning gaseous fuel are available than with natural gas utilizing ordinary mains pressures as mentioned above. However, it will be understood in general that, with some configurations of the catalyst system and of the burner jets, along with appropriate choices of fuels, appropriate provision for obtaining the fuel-air mixtures, and suitable combinations of the fluid velocities through the catalyst and in the gaseous fuel jets, the desired combustion spreading throughout the downstream zone with coalescence of the jets may be obtained across downstream zone widths considerably greater than two inches.

It is for the reasons just discussed that the arrangement of FIG. 11 utilizes more than one ring-shaped catalyst to provide a large volume of hot combustion effluent for mixing with air to be heated. Likewise, when a disk-shaped catalyst such as that shown in FIG. 8 is too small to produce a desired rate of flow of hot effluent gases from a combustion system of the type shown in FIG. 1, the disk-shaped catalyst may be surrounded by one or more nesting ring-shaped catalysts as shown in FIG. 11, and the combined effluent will be available at the outlet of the combustion apparatus. With such a configuration of catalyst bodies, the ring burner 119 as shown in FIG. 8 may have additional openings on its outermost periphery for directing jets of burning gaseous fuel across the inner portions of the outlet face 135 of the catalyst 131 in FIG. 10 or FIG. 11, thus replacing the inner ring burner 137 as there shown.

Numerous other configurations and arrangements of the combustion apparatus of the present invention will be evident to one skilled in the art from the examples and discussion hereinabove. It may be noted that it is not necessary to limit use of the gaseous fuels only to start-up of the combustion apparatus, but the gaseous fuel may continue to be fed at full or decreased rate during steady operation of the combustion apparatus.

The combustion apparatus of the present invention furthermore provides a convenient, relatively inexpensive, and highly effective means for converting from the use of gaseous fuel to use of a liquid fuel, such as diesel oil, which might be more readily available, but not heretofore practically useful for many applications because of excessive formation of pollutants along with difficulties in temperature control, fuel injection especially when cold, and start-up. In fact, such conversions, which might have been practical for some applications before shortages of natural gas developed, more recently have seemed impractical because of much more stringent restrictions impending with respect to polluting emissions. For some operations the gaseous fuel may be used alone, if desired, with supply of some of the combustion air through the catalyst, and the combustion apparatus may be converted from one fuel to the other or may use both fuels simultaneously.

Many commercial installations of combustors utilize normally gaseous fuels for a very broad range of applications, such as heating of buildings, power generation and drying and other processing and heat-treating of a great variety of materials and products. Such gaseous fuels include natural gas which may be pressurized or liquefied for transportation and storage and which typically may contain by volume roughly 90% methane, 6% alkanes of 2–4 carbon atoms, and 4% nitrogen; the gas from liquefied petroleum gas containing essentially propane and butane in a very broad range of proportions; propane itself; and commercial propane which may contain about 5–25% propylene. Gaseous fuels of lower heating values such as producer gas or coal gas may be available in some locations. Natural gas and other such gaseous fuels are known to be burnable using thermal burners of uncomplicated construction, without major problems in effecting fuel injection or fuel-air mixing, to produce a fully combusted, hot effluent containing nitrogen oxides of the order of 70 parts per million (although gaseous fuel combustors for driving turbines tend to be more complicated and to produce nitrogen oxides in higher proportions than do gas burners used directly for heating or processing). Conventional equipment for efficient burning of diesel oil and fuel oil, on the other hand, is more complicated and tends to produce considerably higher proportions of nitrogen oxides. The present invention provides a reasonably compact arrangement for burning a gaseous fuel when available in sufficient quantities and at a practicable cost, and for carrying out catalytically-supported, thermal combustion of carbonaceous fuels, preferably oil, in the same apparatus when gaseous fuels are not available or when substantial formation of nitrogen oxides cannot be tolerated. Both oil and gaseous fuels may be used simultaneously if desired, for example when a higher rate of heat release is desired than can be supplied by the combustion in the presence of the catalyst in a given installation, while still avoiding excessive emissions of nitrogen oxides and other pollutants.

The combustor using the catalyst may be designed for operation using normally gaseous fuels such as propane, butane, and propylene to provide a substantially pollutant-free hot effluent, for example for heating enclosed spaces or for processing of foods. If, however, such a fuel becomes unavailable temporarily, the thermal burner in the apparatus of the present invention may be used instead to burn natural gas or other clean gaseous fuels high in methane. Such alternative operation of the two burners with different gaseous fuels may be advantageous because methane tends to require a catalyst of a different type, or of a greater volume, than the type or volume of certain catalysts specially suited for catalytically supported thermal combustion of the higher gaseous alkanes. Thus it might be impractical to substitute natural gas for commercial propane in the catalyst feed. Likewise, different catalysts may be preferred for burning diesel oil and for burning any of the gaseous fuels, making it undesirable simply to replace diesel oil with gaseous fuel in the catalyst feed.

Thus in a combustor of the type described using a catalyst, the further provision of gaseous fuel burner means for firing the same combustion zone may be useful under some circumstances to alleviate pollution during start-up, and is especially advantageous when so used for direct heating of enclosed spaces. Under other circumstances, the same combustion apparatus with suitable fuel valving is useful to supplement the catalyst combustor when more combustion products are needed. Under still other circumstances, the apparatus serves to burn gaseous fuel only, thus replacing operation using the catalyst with liquid fuel when gaseous fuel is readily available for the thermal burner or in the event that combustion using the catalyst is unsatisfactory due to equipment breakdown or to unavailability of suitable liquid fuel. In the latter case the apparatus includes the catalyst body, its feed means, the thermal burner means, and the supply means for the thermal burner, all arranged with appropriate valving to supply gaseous fuel to the thermal burner only when feed means for the catalyst is not supplying carbonaceous fuel to the catalyst body. With these various available modes of operation, this type of combustion apparatus has a most desirable versatility compared with that of combustion apparatus heretofore available for use with the common fuels.

What is claimed is:

1. Combustion apparatus, comprising:

a catalyst body for combusting carbonaceous fuel passing therethrough;

feed means for supplying a mixture of combustion air and carbonaceous fuel to said catalyst body for flow therethrough to provide a catalyst effluent traversing a downstream zone adjacent to and downstream of said catalyst body;

thermal burner means disposed for directing jets of burning gaseous fuel into said downstream zone from a multiplicity of points distributed within or alongside said downstream zone to obtain combustion of said gaseous fuel in said jets substantially throughout a cross section of said downstream zone; and burner supply means for supplying gaseous fuel when desired to said burner means for obtaining said combustion in said jets substantially throughout a cross section of said downstream zone.

2. The combustion apparatus of claim 1, wherein said feed means includes mixing means for utilizing a liquid carbonaceous fuel to supply said mixture of air and carbonaceous fuel to the catalyst body.

3. The combustion apparatus of claim 2, wherein said feed means includes mixing means for utilizing oil to supply said mixture of air and carbonaceous fuel to the catalyst body.

4. The combustion apparatus of claim 1, wherein said feed means incudes means for supplying, during steady operation of the combustion apparatus, an intimate admixture of air and oil to the inlet surfaces of said catalyst body.

5. The combustion apparatus of claim 1, wherein said downstream zone is generally circular in cross section, and said thermal burner means is a ring burner surrounding said downstream zone and having a multiplicity of discharge openings therearound facing generally radially inwardly for supplying said jets of burning gaseous fuel.

6. The combustion apparatus of claim 5, wherein the catalyst body has the form of a cylindrical monolith with flowthrough passageways extending axially therethrough.

7. The combustion apparatus of claim 1, wherein said catalyst body is elongated in a direction transverse to the direction of flow of said fuel-air mixture therethrough to provide said downstream zone of transversely elongated shape, and said thermal burner means comprises a pair of correspondingly elongated line burners individually disposed along the opposite sides of said elongated catalyst body adjacent to said downstream zone, each of said line burners having spaced therealong a multiplicity of discharge openings for directing gaseous fuel into said downstream zone to provide said multiplicity of jets distributed along the length of said elongated downstream zone.

8. The combustion apparatus of claim 7, wherein the catalyst body has the form of a monolith elongated in one direction with flowthrough passageways extending therethrough in a direction transverse to said direction of elongation and leading into said downstream zone.

9. The combustion apparatus of claim 1, wherein said thermal burner means is disposed and proportioned so as not to impede substantially the flow of said catalyst effluent at least during periods when said burner supply means is not supplying gaseous fuel to the thermal burner means.

10. Combustion apparatus, comprising:

a catalyst body for combusting carbonaceous fuel passing therethrough;

feed means for supplying a mixture of combustion air and carbonaceous fuel to said catalyst body for flow therethrough to provide a catalyst effluent traversing a downstream zone adjacent to and downstream of said catalyst body;

thermal burner means disposed for directing jets of burning gaseous fuel into said downstream zone from a multiplicity of points distributed within or alongside said downstream zone to obtain coalescing of said jets of burning gaseous fuel and intermixing thereof in said downstream zone with substantially all of the catalyst effluent for assisting the combustion of incompletely combusted carbonaceous fuel in said catalyst effluent; and burner supply means for supplying gaseous fuel when desired to said burner means for obtaining said coalescing jets and said intermixing with catalyst effluent.

11. The combustion apparatus of claim 10, wherein said burner supply means is arranged to supply gaseous fuel to said burner means primarily only while said feed means is supplying combustion air and carbonaceous fuel during warm-up of said catalyst body.

12. The combustion apparatus of claim 10, wherein said feed means includes mixing means for utilizing a liquid carbonaceous fuel to supply, during steady operation of said combustion apparatus, the carbonaceous fuel and air in intimate admixture to the inlet surface of said catalyst body.

13. The combustion apparatus of claim 10, wherein said downstream zone is generally circular in cross section, and the thermal burner means is disposed on at least generally opposed sides of said downstream zone for directing said jets of burning gaseous fuel generally inwardly from a multiplicity of points on each of said generally opposed sides.

14. The combustion apparatus of claim 13, wherein said thermal burner means is a ring burner surrounding said downstream zone and having a multiplicity of discharge openings around said ring burner facing generally radially inwardly for supplying said jets of burning gaseous fuel.

15. The combustion apparatus of claim 10, wherein said downstream zone is generally circular in cross section, and the thermal burner means comprises an annular burner disposed across said downstream zone and supported by radial tubes, said annular burner and radial tubes occupying a minor portion of the cross-sectional area of said downstream zone, and said thermal burner means having, for supplying said jets of burning gaseous fuel, a multiplicity of discharge openings around said annular burner facing generally radially inwardly and also having a multiplicity of discharge openings around said annular burner facing generally radially outwardly and along said radial tubes facing generally circumferentially.

16. The combustion apparatus of claim 10, wherein said catalyst body is elongated in a direction transverse to the direction of flow of said fuel-air mixture therethrough to provide said downstream zone of transversely elongated shape, and said thermal burner means comprises a pair of correspondingly elongated line burners individually disposed along the opposite sides of said elongated catalyst body adjacent to said downstream zone, each of said line burners having spaced therealong a multiplicity of discharge openings for directing gaseous fuel into said downstream zone to provide said multiplicity of jets distributed along the length of said elongated downstream zone.

17. The combustion apparatus of claim 10, wherein the catalyst body has the form of a monolith with flow-through passageways extending therethrough and leading into said downstream zone.

18. The combustion apparatus of claim 10, wherein said thermal burner means is disposed and proportioned so as not to impede substantially the flow of said catalyst effluent at least during periods when said burner supply means is not supplying gaseous fuel to the thermal burner means.

19. The combustion apparatus of claim 10, wherein said burner supply means is arranged to supply gaseous fuel to said burner means only when feed means is not supplying carbonaceous fuel to said catalyst body.

20. Combustion apparatus, comprising:

a catalyst body having an inlet face and an outlet face for combusting carbonaceous fuel passing therethrough;

feed means for supplying a mixture of combustion air and carbonaceous fuel to said inlet face of the catalyst body for flow therethrough to provide a catalyst effluent traversing a downstream zone adjacent to and downstream of said outlet face of the catalyst body;

thermal burner means, disposed on at least two generally opposed sides of said downstream zone, for directing a multiplicity of jets of burning gaseous fuel into said downstream zone from each of said generally opposed sides to obtain coalescing of said jets in the inner regions of said downstream zone and intermixing of said burning gaseous fuel with substantially all of the catalyst effluent for assisting the combustion of incompletely combusted carbonaceous fuel in said catalyst effluent; and burner supply means for supplying gaseous fuel to said burner means at least during warm-up of said catalyst body for obtaining said jets and said intermixing with catalyst effluent.

21. The combustion apparatus of claim 20, in which said thermal burner means is disposed for directing said jets of burning gaseous fuel into said downstream zone from each of said generally opposed sides at a predetermined penetration angle defined by the angle between the plane of said outlet face of the catalyst body and the direction of said jets leaving said burner means, and said burner supply means is adapted to supply the gaseous fuel at a rate sufficient, for said predetermined penetration angle, to effect said coalescing of said jets and said intermixing of the burning gaseous fuel with substantially all of the catalyst effluent.

22. In a combustion method wherein carbonaceous fuel and air are passed through an oxidation catalyst body to provide an effluent which traverses a downstream zone adjacent to and downstream of said body, the improvement comprising:

directing jets of burning gaseous fuel into said downstream zone from a multiplicity of points distributed within or alongside said downstream zone to obtain combustion of said gaseous fuel in said jets substantially throughout a cross section of said downstream zone.

23. The combustion method of claim 22, wherein a mixture of said carbonaceous fuel and air is passed through a catalyst body which is elongated in a direction transverse to the direction of flow of said mixture therethrough to provide an effluent which traverses a downstream zone of transversely elongated shape, and wherein said jets of burning gaseous fuel are directed into said downstream zone from a multiplicity of points spaced along each of the elongated sides of said downstream zone.

24. The combustion method of claim 22, wherein said carbonaceous fuel is supplied as a liquid fuel and first is mixed with air to obtain, under steady operating conditions, an intimate admixture of fuel and air prior to passage through said catalyst body.

25. In a combustion method wherein carbonaceous fuel and air are passed through an oxidation catalyst body to provide an effluent which traverses a downstream zone adjacent to and downstream of said body, the improvement comprising:

directing jets of burning gaseous fuel into said downstream zone from a multiplicity of points distributed within or alongside said downstream zone to effect coalescing of said jets and intermixing thereof in said downstream zone with substantially all of said effluent from the catalyst body.

26. The combustion method of claim 25, wherein said carbonaceous fuel is supplied as oil which first is mixed with air to obtain, under steady operating conditions, an intimate admixture of fuel and air prior to passage through said catalyst body.

27. In a method for catalytically-supported, thermal combustion wherein upon attainment of sustained operating conditions carbonaceous fuel and air in intimate admixture are combusted in an oxidation catalyst body the operating temperature of which is substantially above the instantaneous auto-ignition temperature of said fuel-air admixture but below a temperature that would result in any substantial formation of oxides of nitrogen, the improvement comprising:

passing a mixture of said carbonaceous fuel and air in contact with said catalyst body to provide an effluent which traverses a downstream zone adjacent to and downstream of said body; and directing jets of burning gaseous fuel into said downstream zone from a multiplicity of points distributed within or alongside said downstream zone to effect coalescing of said jets and intermixing thereof in said downstream zone with substantially all of said effluent from the catalyst body.

28. The combustion method of claim 27, wherein under some operating conditions of the catalyst body said effluent therefrom contains substantial proportions of incompletely combusted carbonaceous fuel, and said intermixing of said jets of burning gaseous fuel with said effluent during the duration of said operating conditions assists the combustion of said incompletely combusted carbonaceous fuel.

29. The combustion method of claim 27, wherein the carbonaceous fuel supplied for intimate admixture with air, followed by combustion of said admixture in said catalyst body, is a liquid carbonaceous fuel.

30. The method of claim 27, wherein said intimate admixture of carbonaceous fuel and air is passed through flowthrough passageways in a catalyst body having the form of a monolith which is elongated in a direction transverse to the direction of said passageways to provide an effluent which traverses a downstream zone of transversely elongated shape, and wherein said jets of burning gaseous fuel are directed into said downstream zone from a multiplicity of points spaced along each of the elongated sides of said downstream zone.

31. In a method for catalytically-supported, thermal combustion wherein upon attainment of sustained operating conditions carbonaceus fuel and air in intimate admixture are combusted under essentially adiabatic conditions in an oxidation catalyst body the operating temperature of which is substantially above the instantaneous auto-ignition temperature of said fuel-air admixture but below a temperature that would result in any substantial formation of oxides of nitrogen, the improvement comprising:

passing a mixture of said carbonaceous fuel and air in contact with said catalyst body over a period of time, said period including an interval prior to attainment of sustained operating conditions during which said catalyst body is at a temperature below said operating temperature such that the effluent traversing a downstream zone adjacent to and downstream of said body contains substantial proportions of incompletely combusted carbonaceous fuel; and at least during said interval directing jets of burning gaseous fuel into said downstream zone from a multiplicity of points distributed within or alongside said downstream zone to effect coalescing of said jets and intermixing thereof in said downstream zone with substantially all of said effluent from the catalyst body, for assisting the combustion of said incompletely combusted carbonaceous fuel.

32. The combustion method of claim 31, wherein the carbonaceous fuel supplied for intimate admixture with air, followed by combustion of said admixture in said catalyst body, is a liquid carbonaceous fuel.

* * * * *